US006018132A

United States Patent [19]

Chen

[11] Patent Number: 6,018,132

[45] Date of Patent: Jan. 25, 2000

[54] HORIZONTAL TACT SWITCH

[75] Inventor: Chu-Mei Chen, Taipei, Taiwan

[73] Assignee: Hon Hai Precision Ind. Co., Ltd., Taipei Hsien, Taiwan

[21] Appl. No.: 09/384,477

[22] Filed: Aug. 27, 1999

[51] Int. Cl.[7] ..... H01H 1/10

[52] U.S. Cl. ..... 200/406; 200/517; 200/533; 200/551

[58] Field of Search ..... 200/16 R–16 D, 200/512–517, 520–522, 529, 537, 533–535, 542, 547, 551, 246, 275, 284, 402–408, 446

[56] References Cited

U.S. PATENT DOCUMENTS

| | | | |
|---|---|---|---|
| 3,918,020 | 11/1975 | DuRocher | 338/114 |
| 4,153,829 | 5/1979 | Murata | 200/340 |
| 4,398,070 | 8/1983 | Kondo et al. | 200/16 R |
| 4,405,845 | 9/1983 | Kondo et al. | 200/67 DB |
| 4,659,882 | 4/1987 | Hayashi et al. | 200/16 R |
| 5,660,272 | 8/1997 | Janniere et al. | 200/517 |

*Primary Examiner*—Michael Friedhofer
*Attorney, Agent, or Firm*—Wei Te Chung

[57] ABSTRACT

A horizontal tact switch comprises an insulative base having contacts partially retained therein and partially exposing to exterior. A metal cover is fixed to the insulative base and has a plan plate from an edge of which a lever curvedly extends. The lever has an upper contacting portion and a lower pressing portion and the upper contacting portion is proximate to a bottom surface of the plan plate. A pusher is movably received between the insulative base and the metal cover and has a ramp for driving the lever downward when the pusher is depress horizontally. An elastic device is positioned under the pusher and aligned with the lower pressing portion of the lever. A conductor plate comprises a plurality of spring arms each respectively aligned with corresponding one of the partially exposed contacts.

13 Claims, 7 Drawing Sheets

HORIZONTAL TACT SWITCH

BACKGROUND OF THE INVENTION

1. Field of the Invention

The present invention relates to a horizontal tact switch in which a plurality of separate contacts may be electrically connected together via a manual depression on the tact switch.

2. The Prior Art

Tact switches which have quick response to a manual depression have been used in many appliances such as in telephone sets, microwaves, remote controls, TV sets, and etc. Most of the tact switches are made of vertical type rather than horizontal type, therefore they do not meet the low profile requirement for some appliances. One horizontal tact switch has been disclosed in U.S. Pat. No. 5,660,272 which includes a snap metal dome lying over an inner contact and an outer contact, and an actuator arrangement for actuating the snap metal dome upon receiving a manual depression from a horizontal direction. The actuating arrangement includes a sheet metal force transfer member with a horizontal plate and with a deflectable lever, and an actuator device or pusher with a ramp that can engage the lever to deflect it. Normally, the snap metal dome engages them. The outer contact via a peripheral portion thereof is separated from the inner contact. Upon depression on the pusher, a horizontal forward movement of the pusher deflects the front of the lever downwardly, to depress the middle portion of the snap metal dome to engage the inner contact, thereby electrically connecting the outer contact and the inner contact. When the depression is released, the metal dome recovers to the original shape, the lever moves upwardly, and the pusher moves horizontal backward to the original position. A user will feel a click when he/she depresses and releases the pusher. Although this tact switch works well for switching connection between two contacts, it is not easy to simultaneously connecting four contacts by modifying this tact switch. Moreover, the sheet metal force transfer member is apt to have unwanted movement upon receiving force from the pusher. This is because the sheet metal force transfer member only rests on an upper surface of a lower housing part. When the lever of the sheet metal force transfer member receives strong push force from the pusher, the horizontal plate may deflect or move due to insufficient retention to the lower housing part. It is requisite to provide an improved structure of a tact switch for solving the above problems.

SUMMARY OF THE INVENTION

The primary purpose of the present invention is to provide an improved horizontal tact switch which can prevent unwanted movement of any parts thereof from happening during operation of the tact switch.

In accordance with one aspect of the present invention, a horizontal tact switch comprises an insulative base having contacts partially retained therein and partially exposing to exterior. A metal cover is fixed to the insulative base and has a plan plate from an edge of which a lever curvedly extends. The lever has an upper contacting portion and a lower pressing portion and the upper contacting portion is proximate to a bottom surface of the plan plate. A pusher is movably received between the insulative base and the metal cover and has a ramp for driving the lever downward when the pusher is depress horizontally. An elastic device is positioned under the pusher and aligned with the lower pressing portion of the lever. A conductor plate comprises a plurality of spring arms each respectively aligned with corresponding one of the partially exposed contacts. Whereby the pusher may be depressed to move horizontally to drive the lever downward to depress the elastic means, which in turn depresses the conductor plate to electrically contact with the exposed contacts thereby electrically connecting the contacts together, and the electrical connection between the contacts may be eliminated when the depression on the pusher is released.

DETAILED DESCRIPTION OF THE PREFERRED EMBODIMENT

Figure 1:
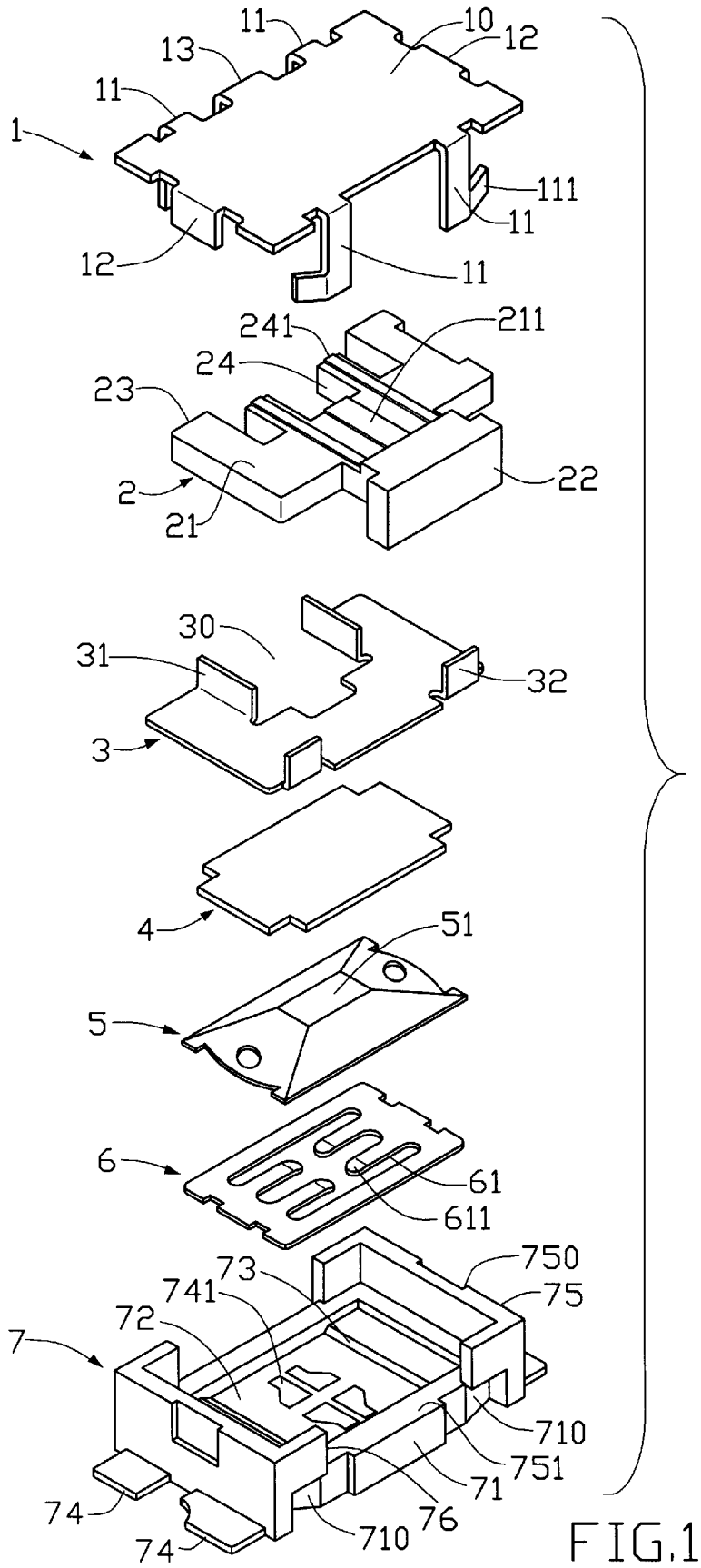
FIG. 1 is an exploded view of a horizontal tact switch in accordance with the present invention.
Figure 2:
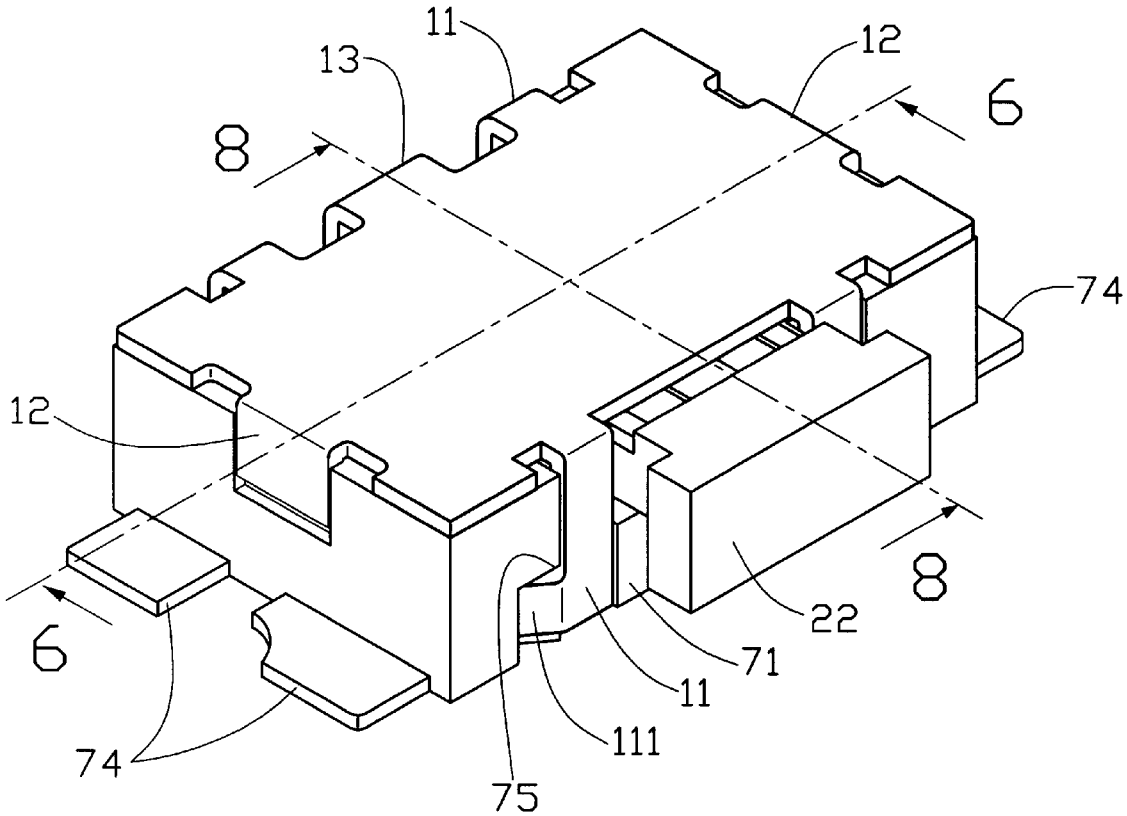
FIG. 2 is an enlarged assembled view of FIG. 1.
Figure 3:
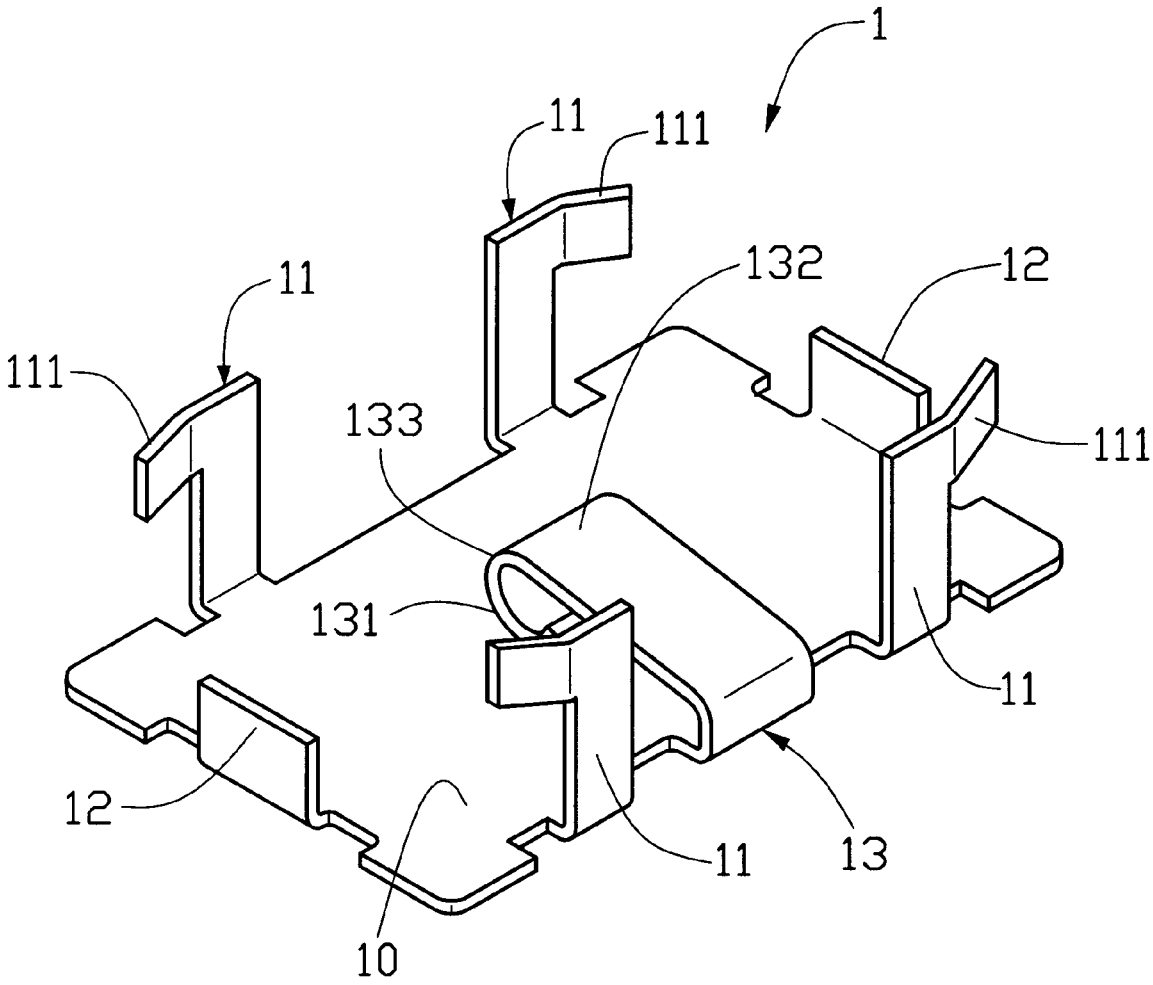
FIG. 3 is a perspective view of the metal cover of FIG. 1 taken from an opposite direction for showing a lever thereof.

Referring to FIGS. 1 and 2, a horizontal tact switch in accordance with the present invention comprises a metal cover 1, a pusher 2, a supporting plate 3, a water-proof tape 4, a metal dome 5, a conductor plate 6, and a base 7. Also referring to FIG. 3, the metal cover 1 has a rectangular plate 10 from front and rear edges of which four tangs 11 extend downward, and from side edges of which two tabs 12 extend downward, wherein the tangs 11 extending from the front edge of the rectangular plate 10 are spaced from each other with a predetermined distance. Each tang 11 has a laterally extended portion 111 extending from one end thereof. A lever 13 extends from the rear edge of the plate 10 having a curved shape under the plate 10 and including an upper contacting portion 131 proximate to the plate 10 and a lower depressing portion 132 defined adjacent to a curved end 133 thereof.

Figure 4:
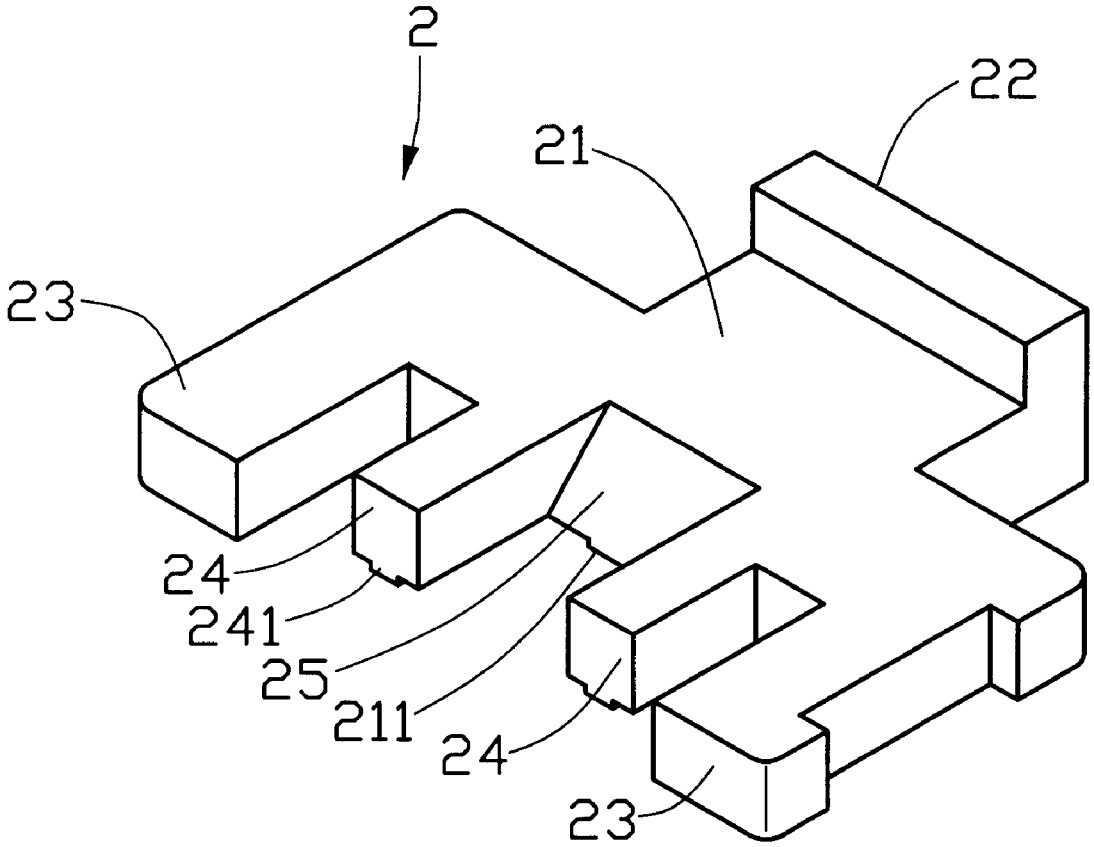
FIG. 4 is a perspective view of the pusher of FIG. 1 taken from an opposite direction for showing a ramp thereof.

Also referring to FIG. 4, the pusher 2 has a T-shaped body 21, a touch pad 22 integrated with a neck portion of the T-shaped body 21, a pair of outer fingers 23 and a pair of inner fingers 24 extending horizontally from a wide rear edge of the T-shaped body 21, wherein a ramp 25 is formed in a middle portion of the rear edge substantially between the inner fingers 24. The outer finger 23 is longer than the inner finger 24. Rails 241 and 211 are respectively formed on top surfaces of the inner fingers 24 and the T-shaped body 21.

The supporting plate 3 is a metal plate having a cutout 30 defined from a rear edge thereof. A pair of first tabs 31 extend upward from opposite edges of the cutout 30 and each of the first tabs 31 is positioned between one pair of the outer finger 23 and the inner finger 24 for guiding the movement of the pusher 2. A pair of second tabs 32 extend upward from a front edge of the supporting plate 3. The metal dome 5 has an upper central area 51 having a rectangular shape and substantially at the top of the metal dome 5. The water-proof tape 4 is made of insulative material and adhered to the upper central area 51 of the metal dome 5. The conductor plate 61 has four spring arms 61 defined in a middle area thereof, and each spring arm 61 has a downwardly bent end 611.

Figure 5:
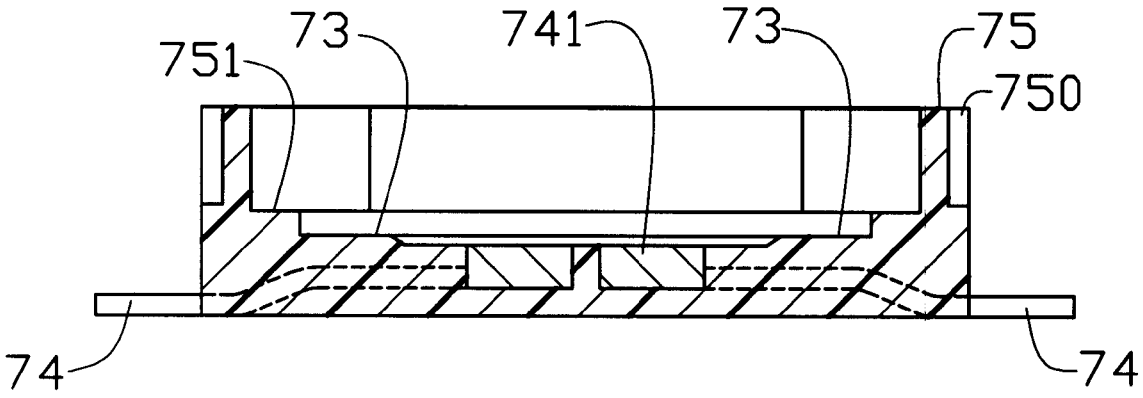
FIG. 5 is a cross-sectional view of the base of FIG. 1.

Also referring to FIG. 5, the base 7 has four contacts 74 partially embedded in a dielectric housing 72 by insert molding. The housing 72 has a periphery wall 71 enclosing therearound thereby defining a cavity (not labeled) therein. Steps 73 are formed on opposite sides of the bottom surface (not labeled) of the cavity and four contacting portions 741 of the contacts 74 expose to external from the bottom surface of the cavity. The periphery wall 71 has an upper surface 751 which is higher than the steps 73. Two U-shaped upper walls 75 extend upward from the periphery wall 71 and define a front entrance 76 and a rear entrance (not labeled) therebetween. Four shallow portions 710 are defined in front and rear sides of the periphery wall 71 for engagement with the bent ends 111 of the tangs 11 of the metal cover 1. Two grooves 750 are formed in opposite sides of the U-shaped upper walls 75 for engagement with the tabs 12 of the metal cover 1.

Figure 6:
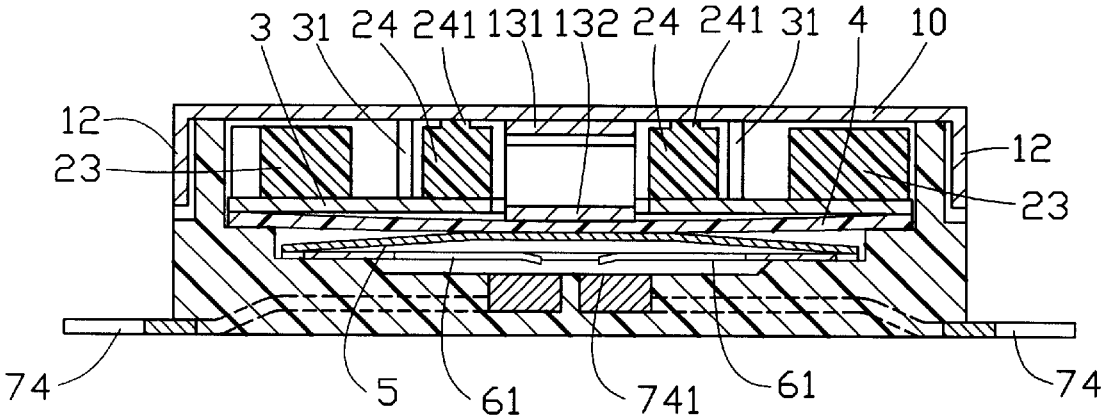
FIG. 6 is a cross-sectional view taken from line 6—6 of FIG. 2 showing a metal dome not depressed.
Figure 8:
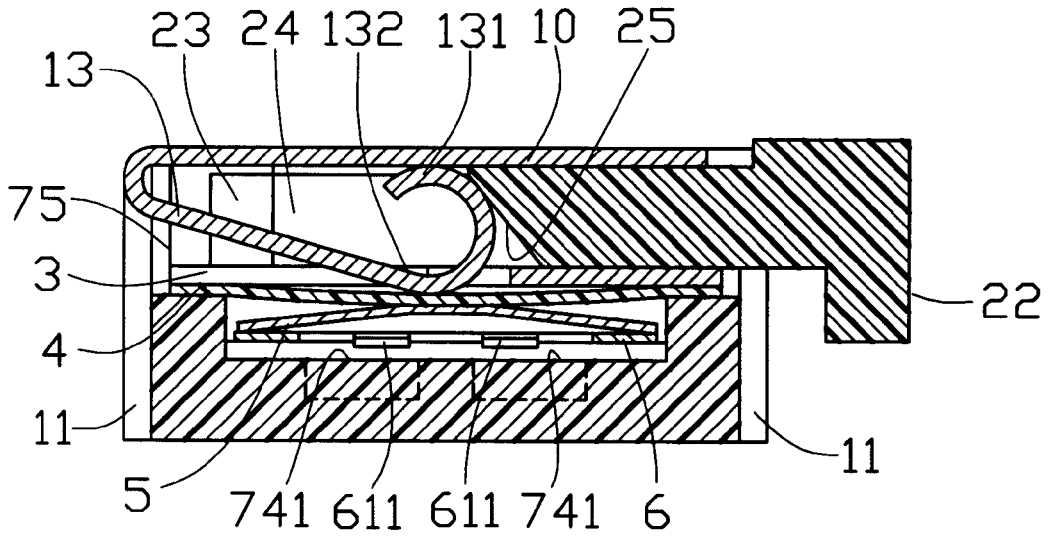
FIG. 8 is a cross-sectional view taken from line 8—8 of FIG. 2 showing a metal dome not depressed.

In assembling, particularly referring to FIGS. 1, 6, and 8, the conductor plate 6 is positioned on the two steps 73, the metal dome 5 to which the central portion of the water-proof tape 4 adheres is positioned on the conductor plate 6. Edge portion of the water-proof tape 4 is attached on the upper surface 751 of the periphery wall 71 preventing water from entering the cavity surrounded by the periphery wall 71. The supporting plate 3 is positioned on the upper surface 751 of the periphery wall 71, with the second tabs 32, the side edges, and the rear edge thereof being retained between inner surfaces of the U-shaped upper walls 75. The pusher 2 is positioned on the supporting plate 3, with the first tabs 31 of the supporting plate 3 being retained in each pair of the outer finger 23 and the inner finger 24 of the pusher 2 and the outer fingers 23 thereof being spaced from the U-shaped upper walls 75 of the base 7 with a predetermined distance. Finally, the metal cover 1 is assembled onto the base 7 by engaging the bent ends 111 of the tangs 11 within the shallow portions 710 of the periphery wall 71, and engaging the tabs 12 thereof with the grooves 750 of the periphery wall 71, meanwhile the upper contacting portion 131 of the lever 13 abuts against the ramp 25 of the pusher 2, and the lower pressing portion 132 of the lever 13 movably surrounded by the inner periphery of the cutout 30 of the supporting plate 3. The rails 211, 241 formed on the top surface of the pusher 2 contact with the metal cover 1 for facilitating movement of the pusher 2 under the metal cover 1 when the pusher 2 is depressed.

Figure 7:
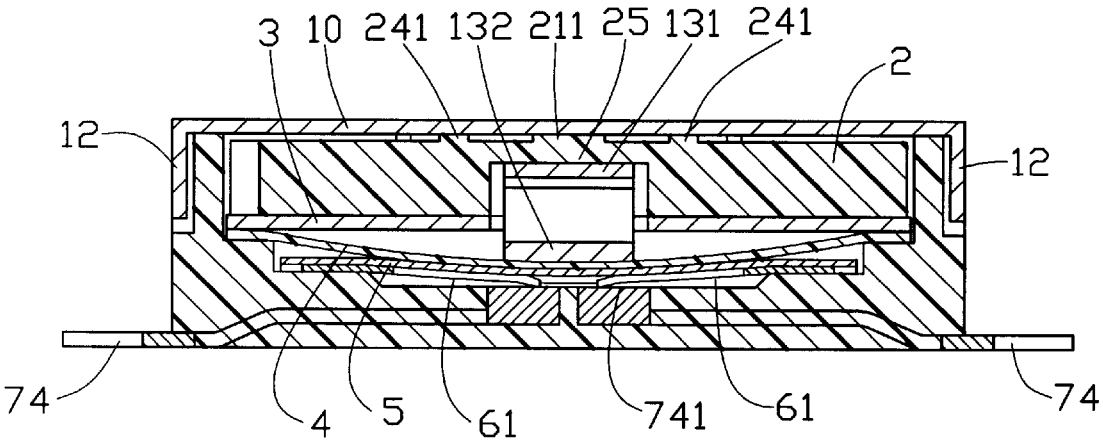
FIG. 7 is a schematic view showing the metal dome of FIG. 6 being depressed.
Figure 9:
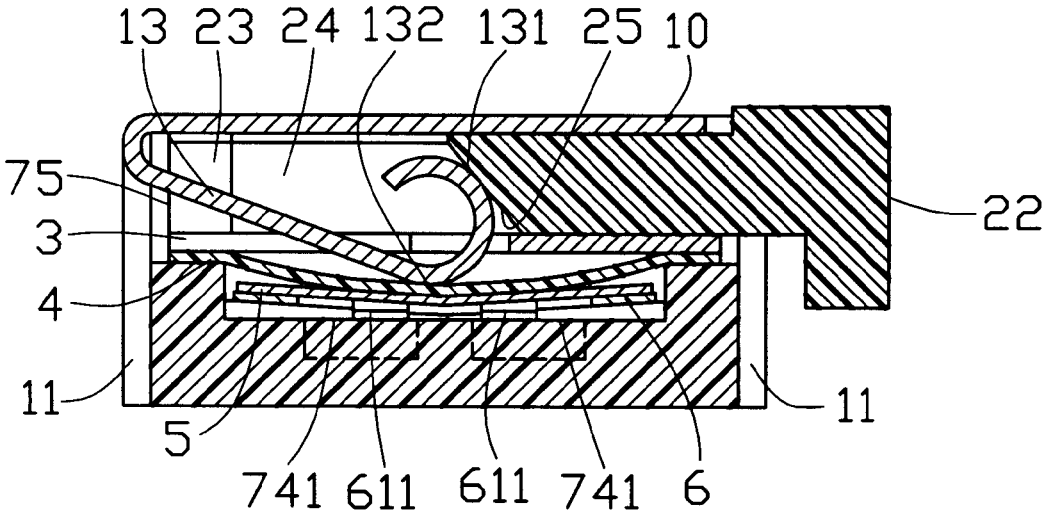
FIG. 9 is a schematic view showing the metal dome of FIG. 8 being depressed.

Referring to FIGS. 7 and 9, during operation, the pusher 2 is pressed horizontally by a user until the outer fingers 23 thereof abuts against the U-shaped upper walls 75 of the base 7 (FIG. 9). Upon depression on the pusher 2, the ramp 25 moves forward to drive the lever 13 of the metal cover 1, thereby forcing the lower pressing portion 132 of the lever 13 to depress the metal dome 5, which in turn depresses the conductor plate 6 and causes the spring arms 61 and their bent ends 611 to electrically connect to the contacting portions 741 of the contacts 74, thereby simultaneously and electrically connecting the four contacts 74. A reverse operation occurs when the depression on the pusher 2 is released, and the four contacts 74 recover to electrical disconnection status.

In practice, the water-proof tape 4 may be omitted if the four contacts 74 are grounding contacts. However, if the four contacts 74 are power contacts, the water-proof tape 4 is preferably retained on the metal dome 5 preventing the contacts 74 from electrically connecting to the metal cover 1. Alternatively, the supporting plate 3 may be omitted for decreasing manufacture cost. However, the supporting plate 3 is preferably used for providing a plan surface on which the pusher 2 may move smoothly and may be guided for movement.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A horizontal tact switch comprising:

an insulative base having contacts partially retained therein and partially exposing to exterior;

a metal cover fixed to the insulative base and having a plan plate from an edge of which a lever curvedly extends, wherein the lever has an upper contacting portion and a lower pressing portion and the upper contacting portion is proximate to a bottom surface of the plan plate;

a pusher movably received between the insulative base and the metal cover and having a ramp for driving the lever downward when the pusher is depress horizontally;

an elastic means positioned under the pusher and aligned with the lower pressing portion of the lever;

a conductor plate having a plurality of spring arms each respectively aligned with corresponding one of the partially exposed contacts;

whereby the pusher may be depressed to move horizontally to drive the lever downward to depress the elastic means, which in turn depresses the conductor plate to electrically contact with the exposed contacts thereby electrically connecting the contacts together, and the electrical connection between the contacts may be eliminated when the depression on the pusher is released.

2. The horizontal tact switch as claimed in claim 1, wherein the insulative base comprises a periphery wall for retaining the elastic means and the conductor plate therein, and two upper U-shaped walls extending upward from the periphery wall for retaining a portion of the pusher.

3. The horizontal tact switch as claimed in claim 2 further comprising an insulative water-proof tape attached to an upper surface of the periphery wall and a top surface of the metal dome.

4. The horizontal tact switch as claimed in claim 3 further comprising a supporting plate rested on the water-proof tape for supporting the pusher to slide thereon.

5. The horizontal tact switch as claimed in claim 4, wherein the supporting plate defines a cutout allowing the lever of the metal cover to move up and down therein.

6. The horizontal tact switch as claimed in claim 5, wherein the metal cover has a plurality of tangs extending downward from different edges thereof for engagement with the base.

7. The horizontal tact switch as claimed in claim 6, wherein each of the tangs has a bent end for engagement within a corresponding shallow portion defined in the periphery wall of the base.

8. The horizontal tact switch as claimed in claim 7, wherein the base has opposite steps extending upward from a bottom thereof for rest of the conductor plate thereby separating the conductor plate from the exposed contacts when the metal dome is not depressed.

9. The horizontal tact switch as claimed in claim 5, wherein the pusher has T-shaped body portion and a pair of inner fingers and a pair of outer fingers extending horizontally from an edge of the T-shaped body portion, wherein the pair of outer fingers is longer than the pair of inner fingers and the pair of outer fingers abuts against the upper U-shaped walls when the pusher is depressed to an extreme.

10. The horizontal tact switch as claimed in claim 9, wherein each pair of adjacent ones of the outer fingers and the inner fingers together movably receives a tab extending upward from the supporting plate thereby guiding the movement of the pusher.

11. The horizontal tact switch as claimed in claim 10, wherein the pusher has at least one rail formed in a top surface thereof for facilitating movement of the pusher under the metal cover.

12. The horizontal tact switch as claimed in claim 1, wherein the elastic means is a metal dome.

13. A horizontal tact switch comprising:

an insulative base having a plurality of contacts retained therein and partially exposed to an exterior;

a cover fixed to said base and including a plan plate with a lever reversely downwardly curvedly extending integrally therefrom, said lever defining an upper contacting portion facing toward the plate and a lower pressing portion facing to the base;

a pusher horizontally moveable between the base and the cover with a ramp sandwiched between the plate and the upper contacting portion; and a deflectable metal dome positioned between the pusher and the base and pressed by the lower pressing portion when the ramp of the pusher is fully position between the plate and the upper contacting portion; wherein said metal dome may be substantially simultaneously electrically connected to some of said contacts thereunder.

* * * * *